United States Patent [19]

Tedford

[11] 4,122,552

[45] Oct. 31, 1978

[54] DISPOSABLE UNDERGARMENTS

[76] Inventor: Fred Tedford, 2291 23rd St., Los Angeles, Calif. 90018

[21] Appl. No.: 848,812

[22] Filed: Nov. 7, 1977

[51] Int. Cl.[2] ..... A41B 9/00

[52] U.S. Cl. ..... 2/78 R; 128/284

[58] Field of Search ..... 2/73, 75, 78 R, 78 C, 2/80, DIG. 6, 400, 401, 109, 111, 78 A, DIG. 7, 76, 183, 197, 221, 269; 128/284, 288; 428/343, 353; 427/207 B

[56] References Cited

U.S. PATENT DOCUMENTS 2,788,786 4/1957 Dexter ..... 128/284

2,834,347 5/1958 Connally ..... 128/284

*Primary Examiner*—Doris L. Troutman

[57] ABSTRACT

Disposable one-piece undergarments, each comprising a generally rectangularly shaped sheet of flexible light weight material, first and second recesses positioned in opposite edges of the sheet complementarily to each other, and bands of connecting material extending along edges of the sheet, each of the bands of connecting material having a plurality of bands of strip-away material thereon, whereby the edges of the garments may be joined together by selective removal of strip-away bands thereby to provide the garments with the size desired.

6 Claims, 5 Drawing Figures

DISPOSABLE UNDERGARMENTS

BACKGROUND OF THE INVENTION

1. Field of the Invention

This invention relates to clothing and is directed more particularly to disposable undergarments.

2. Description of the Prior Art

By and large, undergarments in use today are designed for wear over an extended period of time and designed to outlast many intermittent washings. As such, it is necessary that the garments be frequently laundered and be stored in a place ready for use, and in the case of traveling about, must be packed away in large enough quantity to last the trip.

There have beem suggestions made as to the desirability of disposable garments, a problem being, however, that the many different sizes required of such garments presents a manufacturing problem as well as a retail problem, it being desirable that such disposable products be absolutely as cheap as possible.

It is also desirable that such disposable products be available to the public by way of vending machines, making even more necessary or desirable a universal garment, adaptable to many sizes.

SUMMARY OF THE INVENTION

It is, therefore, an object of the present invention to provide disposable undergarments having a large degree of universality as to size.

A further object of the invention is to provide such garments as will be economical to manufacture and readily adaptable to be vended by way of ordinary vending machines.

A still further object of the invention is to provide such garments as will be easy to properly assemble by a wearer.

With the above and other objects in view, as will hereinafter appear, a feature of the present invention is the provision of disposable one-piece undergarments each comprising a sheet of flexible light weight material having first and second edges parallel to each other and third and fourth edges parallel to each other and normal to and contiguous with the first and second edges, a first recess extending inwardly of the third edge and being generally parabolically shaped, a second recess extending inwardly of the fourth edge and being generally parabolically shaped and positioned complementarily to the first recess, the first recess dividing the third edge into fifth and sixth edge portions and the second recess dividing the fourth edge into seventh and eighth edge portions, each of the fifth, sixth, seventh, and eighth edge portions being provided with a band of connecting material extending from the respective first or second edge to the respective recess, each of the bands of connecting material having a plurality of bands of strip-away material thereon, whereby the fifth and sixth edge portions may be joined together by selective removal of the strip-away bands, and the seventh and eighth edge portions may be joined together by selective removal of the strip-away bands, thereby to provide the garment with the size desired.

The above and other features of the invention, including various novel details of construction and combinations of parts, will now be more particularly described with reference to the accompanying drawings and pointed out in the claims. It will be understood that the particular garments embodying the invention are shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
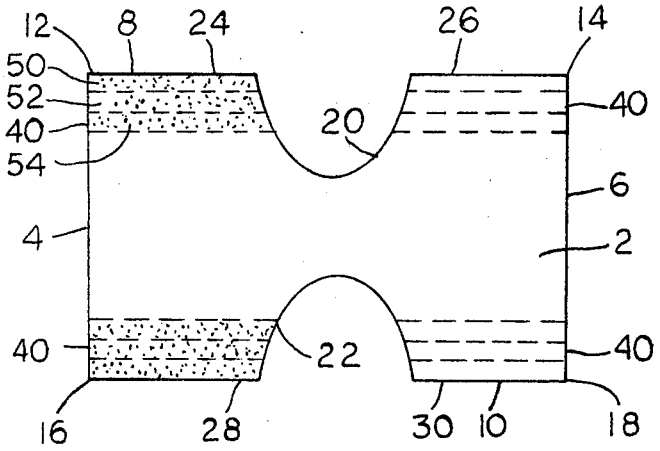
FIG. 1 is a plan view of one form of garment illustrative of an embodiment of the invention.
Figure 2:
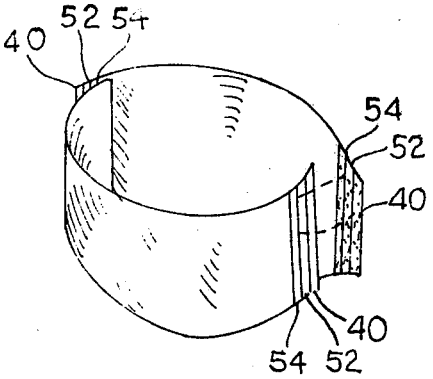
FIG. 2 is a perspective view of the garment of FIG. 1 being assembled for use.
Figure 3:
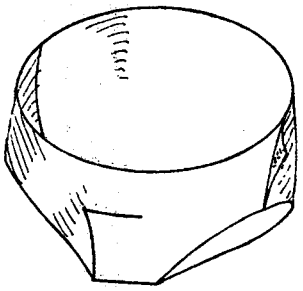
FIG. 3 is a perspective view of the garment of FIG. 1 fully assembled for use.
Figure 4:
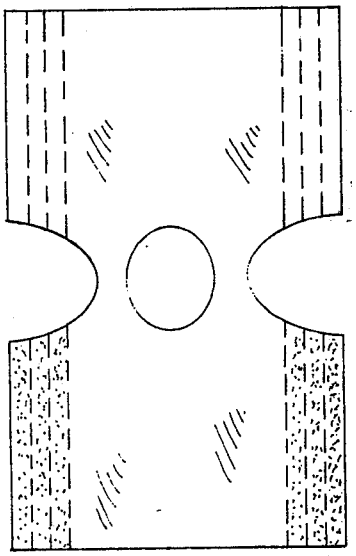
FIG. 4 is a plan view of another form of garment illustrative of a second embodiment of the invention.

Referring to FIGS. 1–3, it will be seen that the garment includes a sheet of flexible material 2 having a first edge 4 and a second edge 6, the first and second edges 4, 6 being parallel to each other. The sheet of material 2, also has a third edge 8 and a fourth edge 10, the third and fourth edges being parallel to each other and being normal to the first and second edges 4, 6. The third edge 8 is contiguous with the first and second edges 4, 6 thereby to define two corners 12, 14, as seen in FIGS. 1 and 4, and the fourth edge 10 is contiguous with the first and second edges 4, 6 to form corners 16, 18 as seen in FIGS. 1 and 4.

The third edge 8 is provided with a first recess 20 extending inwardly of the third edge 8 and being generally parabolically shaped. A second recess 22 extends inwardly from the fourth edge 10 and is in like manner generally parabolically shaped and is positioned complementarily to the first recess 20.

The first recess 20 divides the third edge 8 into fifth and sixth edge portions 24, 26 and the second recess 22 divides the fourth edge 10 into seventh and eighth edge portions 28, 30.

Each of the fifth, sixth, seventh, and eighth edge portions 24, 26, 28, 30 are provided with a band of connecting material 40, as for example, hermaphroditic material, extending from the respective first or second edge 4, 6 to the respective recess 20, 22. Each band of hermaphroditic material 40 has disposed thereon a plurality of narrower bands of strip-away material 50, 52, 54. Preferably, the bands of hermaphroditic material are on opposite sides of the sheet 2 to facilitate joining together of connecting edges, as illustrated in FIG. 2 and described below.

The garment of the present invention is preferably of a light, porous material, such as paper or of a paper-related material.

In use, the garment of the present invention may be folded and packaged in a small unit readily adaptable to machine vending. A user folds the sheet shown in FIG. 1 so that the first and second edges 4, 6 are brought toward one another. The edge portions 24 and 26 are then brought together, as well as the edge portions 28 and 30, as shown in FIG. 2. Referring to FIG. 2, it will be seen that at the left hand side of the garment as viewed in the drawing, the narrow protective strips 52, 54 remain on the bands 40 but the protective band 50 has been removed, exposing a portion of the underlying hermaphroditic band 40. In like manner, referring to the right hand portion of the garment as seen in the drawing, the protective bands 52, 54 remain but the protective bands 50 have been removed revealing the underlying band of material 40. In the illustration shown in FIG. 2, a large size is desired and the protective bands 50 nearest the outer edges of the garment have been selected. If it were desired to produce a smaller size from the same article it would be necessary only to leave intact the protective bands 50 and to remove instead bands 52, or if an even smaller size is desired, bands 54. Needless to say, a mixture of bands removed may provide sizes inbetween. For example, from the edge portion 24 one may remove the protective band 50 and from the edge 26 one may remove the protective band 52 to provide a size inbetween the sizes realized by removing only bands 50 or bands 52.

Figure 5:
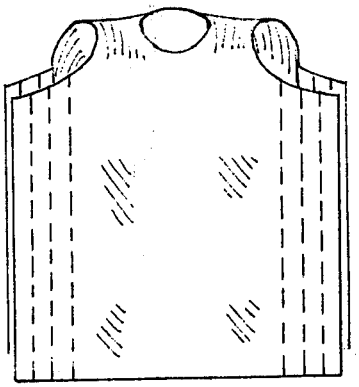
FIG. 5 is a perspective view of the garment of FIG. 4.

The garment $2^1$ shown in FIGS. 4 and 5 conforms substantially to the above description relative to the garment shown in FIGS. 1–3, the former being provided, however, with a central opening 56 to receive the head and fit about the neck of a wearer. This garment is folded as shown in FIG. 5 and then fastened as described above relative to FIG. 2.

It is to be understood that the present invention is by no means limited to the particular construction herein disclosed and/or shown in the drawings, but also comprises any modifications or equivalents within the scope of the disclosure. For example, although the garment has been described as having hermaphroditic connecting means along certain of its edges, it will be apparent that the garment might just as well be fitted with broad bands of adhesive material covered by a plurality of narrower bands of protective material.

Having thus described my invention what I claim as new and desire to secure by Letters Patent of the United States is:

1. A disposable one-piece undergarment comprising a sheet of flexible light weight material having first and second edges parallel to each other and third and fourth edges parallel to each other and normal to and contiguous with said first and second edges, a first recess extending inwardly of said third edge and being generally parabolically shaped, a second recess extending inwardly of said fourth edge and being generally parabolically shaped and positioned complementarily to said first recess, said first recess dividing said third edge into fifth and sixth edge portions and said second recess dividing said fourth edge into seventh and eighth edge portions, each of said fifth, sixth, seventh, and eighth portions being provided with a band of connecting material extending from the respective first or second edge to the respective recess, each said band of connecting material having a plurality of narrower bands of strip-away material side-by-side thereon, whereby said fifth and sixth edge portions may be joined together by selective removal of said strip-away bands, and said seventh and eighth edge portions may be joined together by selective removal of said strip-away bands, thereby to provide said garment with a size desired.

2. The invention according to claim 1 in which each said band of connecting material comprises a band of hermaphroditic material.

3. The invention according to claim 1 in which each said band of connecting material comprises a band of adhesive material

4. The invention according to claim 1 in which said sheet of flexible material comprises paper.

5. The invention according to claim 1 in which a first of said bands of connecting material is disposed on a first side of said sheet and a second of said bands of connecting material is disposed on a second side of said sheet.

6. The invention according to claim 1 in which said sheet is provided with a centrally disposed opening.

* * * * *